United States Patent [19]

Lapraik

[11] 4,317,609

[45] Mar. 2, 1982

[54] ELECTRICAL CONTACT

[75] Inventor: Scott J. Lapraik, Pleasantville, Pa.

[73] Assignee: GTE Products Corporation, Stamford, Conn.

[21] Appl. No.: 270,324

[22] Filed: Jun. 4, 1981

Related U.S. Application Data

[63] Continuation of Ser. No. 64,670, Aug. 8, 1979, abandoned.

[51] Int. Cl.[3] ..... H01R 13/40

[52] U.S. Cl. ..... 339/221 R; 339/258 R

[58] Field of Search ..... 339/221 R, 221 M, 258 R, 339/258 P, 259, 258 F

[56] References Cited

U.S. PATENT DOCUMENTS

| | | | |
|---|---|---|---|
| 2,779,011 | 1/1957 | Deakin | 339/258 R |
| 3,757,284 | 9/1973 | Klehm, Jr. | 339/258 R |
| 3,787,801 | 1/1974 | Teagno et al. | 339/258 R |
| 3,806,859 | 4/1974 | Madarasz et al. | 339/258 R |
| 3,838,388 | 9/1974 | Baüerle et al. | 339/258 R |
| 3,915,537 | 10/1975 | Harris et al. | 339/258 R |

FOREIGN PATENT DOCUMENTS

| | | | |
|---|---|---|---|
| 2036990 | 2/1971 | Fed. Rep. of Germany | 339/258 R |
| 1515112 | 1/1968 | France | 339/258 R |

*Primary Examiner*—Joseph H. McGlynn
*Attorney, Agent, or Firm*—Robert E. Walter

[57] ABSTRACT

An electrical contact for a connector of the type used for engaging the edge portion of a printed wiring board has a U-shaped walled section with a pair of leg sections joining a bight section. A pair of flat inwardly bowed tines extend upwardly from respective upper portions of each leg section. An elongated member depends from an upper portion of the bight portion and extends downwardly through a reverse bend and includes a lower depending tail portion.

1 Claim, 3 Drawing Figures

ELECTRICAL CONTACT

This is a continuation of application Ser. No. 64,670, filed Aug. 8, 1979, now abandoned.

BACKGROUND OF THE INVENTION

The present invention relates to electrical contacts and more particularly, to electrical contacts of the type used for providing mechanical and electrical connection with a printed wiring board.

Many electrical circuits are printed, or otherwise formed on either surface or both surfaces of an insulating substrate. The boards or substrates are inserted into receptacles which are then interconnected into other circuit devices to form complex electronic devices. The board generally has a plurality of conductive pads or strips on the marginal portion thereof which make contact to a "chip" or other electronic device in the center portion thereof.

For engaging the conductive portions or strips, the connector typically includes a plurality of contacts which include opposing flat portions or tines for contacting the printed wiring board on either side thereof and along an edge. The contacts are so arranged that the electrical connection with the board is completed by inserting the board edgewise into a plurality of contacts to mechanically and electrically engage the contact points.

The other end of the contact typically includes the post projecting outwardly which in some cases may be inserted into a mounting member, metal cladded holes in another board or served as posts to permit a wire wrapping process.

U.S Pat. No. 3,764,955 to Ward describes an elongated mounting bar having a plurality of aligned spring receptacles mounted thereon for receiving and supporting a substrate. The receptacles have posts which are adapted to enter holes in a printed circuit board.

SUMMARY OF THE INVENTION

It is an object of the present invention to provide an improved connecting means for mounting substrates along an edge thereof and providing electrical connection with conductive strips thereon.

Further object is to provide an electrical contact which is of relatively simple construction which can be manufactured at a low cost.

These and other objects of the present invention will become apparent from a reading of the following description.

In accordance with the present invention, there is provided an electrical contact comprising a U-shaped walled section having a pair of leg sections joining a bight section, a pair of flat tines, each tine being inwardly bowed and extending upwardly from an upper portion of each leg section, an elongated member depending from an upper portion of said bight portion and extending downwardly through a reverse bend, said member including a lower tail portion.

DETAILED DESCRIPTION OF THE INVENTION

Figure 1:
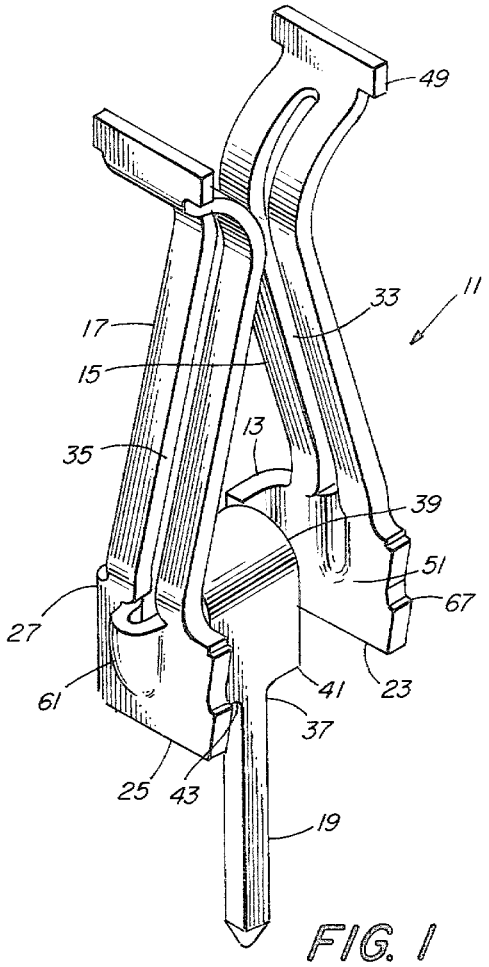
FIG. 1 is a perspective view of the contact.

With reference to the drawings, the contact generally indicated at 11 comprises a U-shaped upright walled section 13 including a pair of tines or fingers 15, 17 projecting upwardly. The tines 15, 17 wipe against conductive strips as a printed wiring board is forced therebetween. The tines 15, 17 yield outwardly due to their resilience and generate holding forces which serve to keep the board in place and establish electrical continuity with the conductive strips on the board. A depending tail portion 19 of the contact provides for electrical connection to an external circuit such as plated through holes of another circuit board or by wire wrapping.

The U-shaped walled section 13 includes leg section 23, 25 with adjoining bight section 27. The lower edge 29 of the U-shaped walled section lies in a substantially constant plane with the legs 23, 25 and bight section 27 extending substantially normal thereto.

The contact 11 includes a pair of tines 15, 17 which are inwardly bowed and extend upwardly from an upper portion of each of the leg sections 23, 25. Each of the tines 15, 17 extend upwardly from the respective leg sections 23, 25 so that respective flat faces are bend toward the longitudinal axis of the contact 11 so as to form a spring type contact section spaced from the U-shaped walled section 13. The respective tines 15, 17 terminate an outwardly extending T-shaped section 49. As illustrated in the drawings, each of the tines includes a respective longitudinal slots 33, 35 extending along the length thereof.

Figure 3:
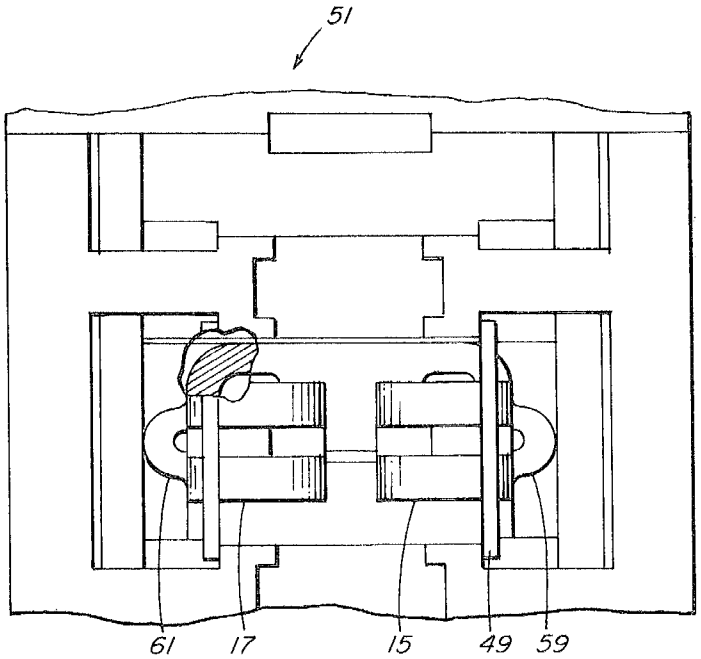
FIG. 3 is a top elevational view including a partial section of a mounted contact.
Figure 2:
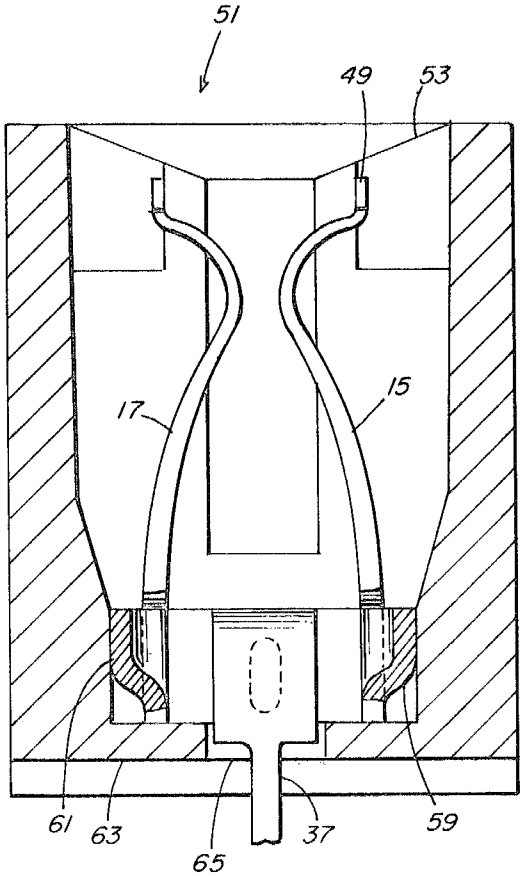
FIG. 2 is a side elevational view in section of a mounted contact.

As shown in FIGS. 2 and 3, the contact 11 of the present invention may be used in conjunction with mounting member 51 constructed with an insulating material. Mounting member 51 includes a plurality of vertically aligned partitions 53 forming recesses therebetween for accommodating the tines 15, 17. The T-shaped ends 49 of the tines 15, 17 bear against a flange 57 of the partition 53. The mounting member 51 provides alignment for a board as it is inserted between the rows of opposing tines 15, 17.

In accordance with the principles of the present invention, an elongated member 37 depends from an upper portion of the bight portion 27 and extends downwardly through a reverse bend 39. The member 37 prior to bending is in a upright position. It is then bent inwardly toward the longitudinal axis of the contact 11 and downwardly at approximately 180 degree angle. After bending, the member 37 extends downwardly adjacent the inner surface of the bight portion 27. A pair of shoulders 41, 43 lie in a plane substantially corresponding to the plane of the bottom edge 29 of the U-shaped section 13 to provide a firm mounting base. The tail section 19 depends downwardly.

The contact 11 includes means for securing the contact 11 to mounting member 51 in the form of protuberances 59, 61. Each of the legs 23, 25 include a respective protuberance 59, 61 which are in the form of a dentent having one end thereof displaced from the walled section 13 so as to be resiliently biased inwardly. The other end of the respective protuberances 59, 61 is rounded and smoothly blends with the walled section 13. As illustrated in FIG. 2, the mounting member includes floor section 63 having a plurality of aperatures 65 therein. The aperatures 65 are dimensioned so a force fit is achieved between the protuberances 59, 61 and the inside surface of respective aperatures 65. As the contact 11 is force fitted the rounded portion of the protuberances 59, 61 and in preventing destruction to the aperature 65 so that defective contacts 11 may be replaced.

The contact 11 may be provided with further securing or retaining means in the form of barbs 67 which project outwardly from the ends of respective leg section 23, 25. The barbs 67 engage the inside surface of respective aperatures 65 to provide additional retention.

The contact 11 of the present invention may be conveniently stamped from a sheet of material with a minimal amount of material wasted. The basis cut out may be stamped from a flat rectangular section of a conductive material such as copper. Subsequent bending operations result in the formation of reverse bend in the depending member 37 and the U-shaped member with depending tines.

While the invention has been described herein with reference to certain examples and preferred embodiments, it is to be understood that various changes and modifications may be made by those skilled in the art without departing from the concept of the invention, the scope of which is to be determined by reference to the following claims.

I claim:

1. An electrical contact of the type having a pair of flat tines for contacting both sides of a substrate in combination with a mounting member of the type having an aperture with an inside surface and a floor section, said combination comprising an electrical contact including a U-shaped walled section having a lower edge lying substantially within a plane for engaging said floor section and a pair of leg sections forming a bight section, each leg section includes an outwardly projecting protuberance formed from a dented in said walled section engaging the inside surface of the aperture for securing said contact within said aperture, a pair of flat tines, each tine being inwardly bowed and extending upwardly from an upper portion of each leg section, an elongated member depending from an upper portion of said bight portion and extending downwardly adjacent the inner surface of the bight portion through a reverse bend, said elongated member including a tail portion extending through the floor section for making contact with an external circuit.

* * * * *